United States Patent [19]

Molitorisz

[11] Patent Number: 5,011,197

[45] Date of Patent: Apr. 30, 1991

[54] METHOD FOR TYING TWINES INTO CLOSED LOOPES

[76] Inventor: Joseph Molitorisz, 1506 13th St., Ames, Iowa 50010

[21] Appl. No.: 472,853

[22] Filed: Jan. 31, 1990

[51] Int. Cl.[5] ..... B65H 69/04

[52] U.S. Cl. ..... 289/1.5; 289/17; 289/18.1

[58] Field of Search ..... 289/1.5, 17, 18.1; 53/370; 100/29, 31; 140/93.2, 93.6, 118, 149

[56] References Cited

U.S. PATENT DOCUMENTS

| | | | |
|---|---|---|---|
| 911,885 | 2/1909 | Landfear | 289/18.1 |
| 911,886 | 2/1909 | Landfear | 289/18.1 |
| 1,845,235 | 2/1932 | Campbell et al. | 289/18.1 X |
| 3,075,794 | 1/1963 | Inderfurth et al. | 289/1.5 |
| 3,264,022 | 8/1966 | Talbot | 289/1.5 |
| 3,283,474 | 11/1966 | Bower | 53/370 X |
| 3,380,486 | 4/1968 | Yonan | 140/93.6 X |
| 4,178,845 | 12/1979 | De Gryse | 100/31 X |

*Primary Examiner*—Peter Nerbun
*Assistant Examiner*—Michael A. Neas
*Attorney, Agent, or Firm*—Zarley, McKee, Thomte, Voorhees

[57] ABSTRACT

This invention pertains to a method for securing twines or strings made of natural or synthetic fibers into tightly wrapped closed loops around bales, boxes or other objects. It applies the knotting effect of twines, when under proper tension are twisted together into overlapping multiple strands.

1 Claim, 1 Drawing Sheet

METHOD FOR TYING TWINES INTO CLOSED LOOPES

BACKGROUND OF THE INVENTION

Twines made of natural or synthetic fibers are commonly used to tie loose fibrous substances, such as hay and straw into bales for handling and transportation. The tying process of hay balers is automatic, placing twines around the bale in loops, and tying the two ends of each looped twine into knots. The tying methods applied in the currently available baling apparatuses produce loose loops, allowing the expansion of the bales, thereby reducing the final density of the baled substance.

For improved performance of the baling apparatuses, a better tying method is needed, which can produce tightly wrapped loops, not allowing the expansion of the bale after its release from the compressive forces of the baling apparatus.

The currently marketed tying apparatuses have complex mechanism, requiring frequent adjustments, and calling for rather exact control of the tension in the twine for proper function.

The complexity of the currently marketed tying apparatuses substantially increases the price of the balers. Simpler and less costly tying mechanism is most desirable.

The aim of my invention is to satisfy the above requirements.

SUMMARY OF THE INVENTION

My invention applies the knotting effect of twines, made of natural or synthetic fibers, when placed around an object in loops with sufficient length. Two cut ended strands are twisted together, under proper tension, into single, overlapping multi-strandad configuration, forming tightly wrapped closed loops.

DETAILED DESCRIPTION OF THE INVENTION

Figure 1A:
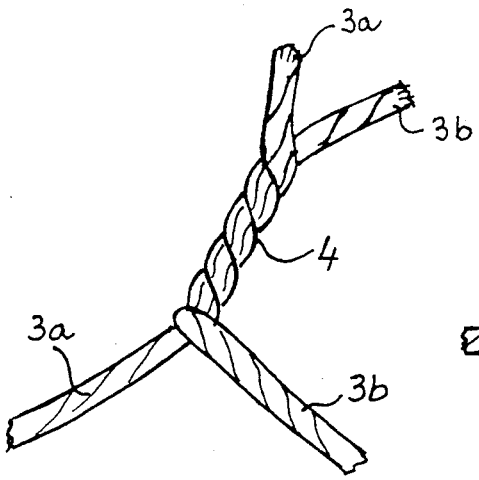
FIG. 1*a–d* are schematic diagrams illustrating the subsequent stages of the twist tying process of a twine.

The tying process of this invention is as follows: The twine with sufficient length is placed around the object, such as a bale, to form a loop. Its two cut ended single strands are received by the twine twisting mechanism, which applies twisting action on the two converging strands, twisting them together into a single, double-strandad configuration, forming a closed loop around the object. In the first phase of the twisting action the two single strands begin to form a twisted double strand at the twisting mechanism, gradually advancing the twisting action toward the object, thereby tightening the loop around the object. Simultaneously, the angle between the two single strands, as those depart from the object and converge into a double strand, increases. The twisting action reduces the length of the strands between the object and the twisting mechanism, which is compensated for by allowing the corresponding movement of the twisting mechanism toward the object, against controlled resistive forces, thereby maintaining the necessary tension for the proper formation of the twisted strands.

The second phase of the twisting process begins when the angle between the two converging single strands of the twine approaches 180 degrees, at which time an overlapping twisting action begins, first winding one of the two converging single strands on top of the already formed double strand, beginning at the point where the two single strands converge into the twisted doublestrand, pulling and bending the double stranded twine toward the single strand which is being overlappingly twisted around the double stranded twine. As the angle between the single strand and the double strand decreases, while the twisting action continues, they become twisted together into a triple strand. The direction or sense of the winding of the single strand on top of the double strand is opposite to the direction or sense of the twisting of two single strands into a double strand. The reversal of the direction of the winding produces a locking effect on the strands of the twine, preventing the unwinding of the twisted strands under the action of the tensil forces in the looped twine. While the formation of the triple strand occures, the tension in the two single strands around the object increases, pulling the triple stranded twine against the body of the object, thereby producing an additional locking effect against the reversal of the twisting action by the tensil forces in the twine after releasing the twines from the twisting mechanism. During both the first and the second phases of the twisting action the twisting mechanism is allowed to follow the changes in the length of the strands of the twine, while maintaining the necessary tension in the strands for proper twisting action. Under the action of the increasing torsional forces a coiled configuration developes in the portion of the double-strandad twine not twisted into the triple strand. This coiling effect further improves the knotting of the looped twine, as the large diameter of the coiled double strandad twine does not allow it to pass through between the object and the tightly held single strands of the twine forming the loop around the object.

After completing the tightly wrapped closed loop, and at a preset tension in the twisted strands, the twisting mechanism automatically releases the twine.

In the continuous operation of a baling apparatus, putting more than one loop of the twine around each bale, each loop is made separately by a twisting unit. The twines are held across the path of the bale, as it is being formed, and the loops around the bale are completed by the use of movable needles, which after the bale reaches the desired length deliver the twines from the twines storage container to the twisting mechanism. Each loop of the twine is held by a separate twisting unit of the mechanism. After the delivery of the twines by the needles the twine twisting mechanism firmly hold the twines in closed loops around the bale, the needles return to their home positions. During the twisting process the twisting mechanism is pulled toward the bale by the twisted strands. At the completion of the process the ends of the twisted strands are pulled free from the twisting mechanism and under the action of the applied forces the twisting mechanisms return to their home positions for tying the next bale.

In the first stage, shown of FIG. 1*a*, the formation of the twisted double strand configuration 4, of the two cut ended single strands 3*a* and 3*b* of the twine begins.

Figure 1B:
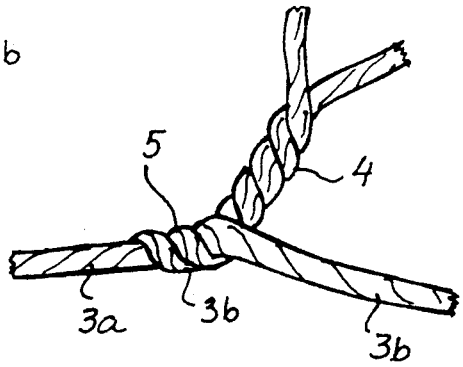
Figure 1C:
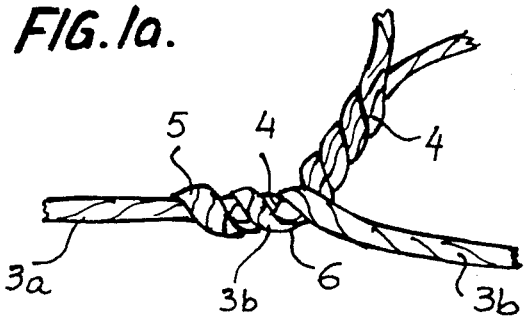

The second stage is illustrated on FIG. 1*b*, when under the continued twisting action on the double strand 4, the angle between the strands 3*a* and 3*b* approaches 180 degrees, as the tension in the twine increases. The interaction between the increasing angle and the increasing tension in the two strands of the twine, cause the pulling of the double strand 4 toward the single strand 3*b*, resulting in the overlapping winding 5 of the double strand 4 and the single strand 3*b* into a triple strand 6, the direction or sense of which is opposite to that of the double strand 4. The stage is illustrated on FIG. 1*c*.

Figure 1D:
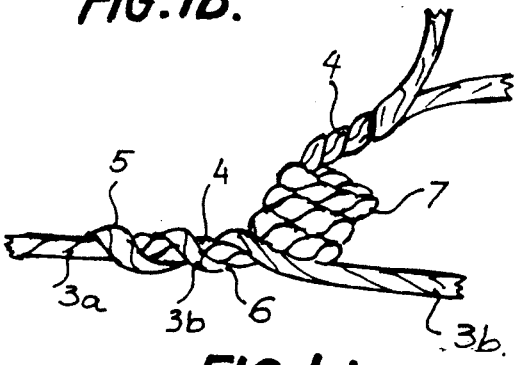

FIG. 1*d*, illustrates the final stage of the process when under the increasing torsional forces on the double strand 4, and with the increasing tension in the strands 3*a* and 3*b*, the coiling configuration 7 of the double strand developes, pulling the strands of the twine free from the holding element of the twisting mechanism.

Figure 2A:
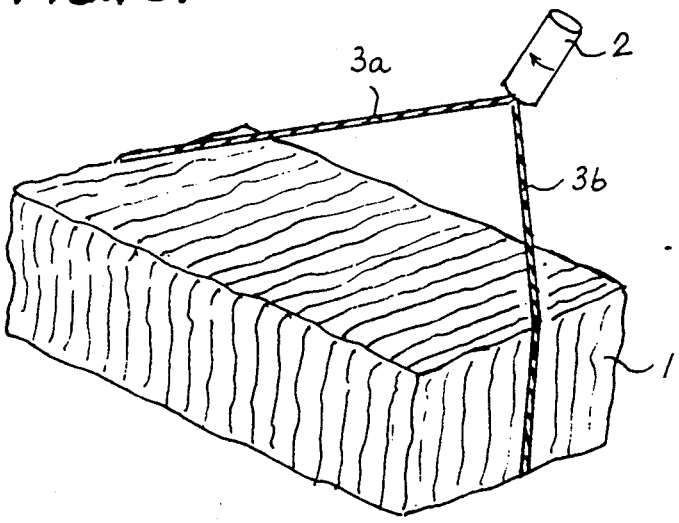
FIGS. 2*a* and 2*b* illustrate the general arrangement of the twine around a bale.
Figure 2B:
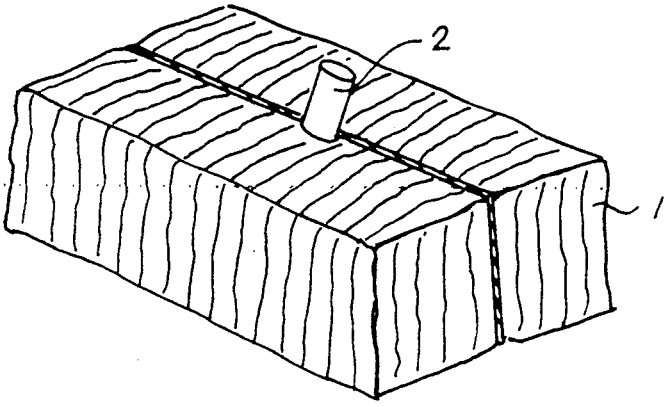

FIGS. 2*a* and 2*b* illustrate the general arrangement of the twine around a bale 1, and the relative positions of the twine twisting mechanism 2, at the beginning and at the end of the tying process. In FIG. 2*a* the twine is formed into a loose loop around the bale, as the two cut ended strands 3*a* and 3*b* are held by the twine twisting mechanism 2, which exerts the twisting action on the two strands 3*a* and 3*b*. At the conclusion of the tying process the twisting mechanism 2 is pulled toward the bale where the twines are relased.

I claim:

1. A method to secure a twine including a pair of strands tightly wrapped in a closed loop around an object comprising the steps of, placing the twine around an object in suitable length to form a loop around the object, placing ends of the pair of strands which includes two single strands together, twisting the two single strands into a double strand forming a tightly wrapped closed loop of the twine around the object, continuing the twisting action and causing a portion of one of the single strands of the twine forming the tightly wrapped loop around the object to be twisted together with a portion of the double strand, forming a triple strand of the twine with the direction and sense of the winding of the double strand and one of the single strands being opposite to the direction and sense of the twisting of the two single strands into a double strand, resulting in the overlapping twisting of the single and the double strands of the said twine, producing a knotting effect on the looped twine, preventing the reversal of the twisting of the strands of the twine under the action of the tensile forces acting on the looped twine securing the looped twine around the object, continuing the twisting action of the portion of the double strand of the twine not being twisted into the triple strand to form a coiled configuration while moving the ends of the pair of strands toward the object following the changes in the length of the twisted strands during the twisting process, and releasing the twine.

* * * * *